US005287038A

United States Patent [19]

Hagar et al.

[11] Patent Number: 5,287,038

[45] Date of Patent: Feb. 15, 1994

[54] HIGH RESOLUTION ELECTRON GUN

[75] Inventors: Robert A. Hagar, Tempe; Arthur J. Ingle, Chandler, both of Ariz.

[73] Assignee: Litton Systems, Inc., Beverly Hills, Calif.

[21] Appl. No.: 884,523

[22] Filed: May 14, 1992

[51] Int. Cl.[5] ..... H01J 29/46; H01J 29/56

[52] U.S. Cl. ..... 315/15; 315/382; 313/414

[58] Field of Search ..... 315/14, 15, 382, 382.1; 313/414, 447, 449

[56] References Cited

U.S. PATENT DOCUMENTS

| | | | |
|---|---|---|---|
| 4,363,996 | 12/1982 | Mizushima et al. | 313/449 |
| 4,486,687 | 12/1984 | Epsztein | 315/14 |
| 4,806,821 | 2/1989 | van Gorkum | 313/449 |
| 5,034,654 | 7/1991 | Leyland et al. | 313/414 |

*Primary Examiner*—Theodore M. Blum
*Attorney, Agent, or Firm*—Graham & James

[57] ABSTRACT

An improved resolution electron gun for a cathode ray tube(CRT) is provided having a cathode, a control grid and an anode. A positive voltage is applied to the anode for the purpose of drawing the electron beam from the cathod, which emits the electron beam along its principal axis. The control grid between the cathode and the anode has a modulating drive voltage to modulate the emitted beam. The anode and the grid are aligned along the principal axis of the cathode and are adjacent to one another. A limiting aperture is mounted along the principal axis to clip the beam and reduce its diameter. A screen is provided along the principal axis within the CRT to receive the projected beam. To obtain increased resolution, the modulating drive voltage is increased while the aperture size is decreased. More specifically, the modulating drive voltage is increased beyond 25% of a predetermined maximum cutoff value, and the limiting aperture permits less than 50% of beam current to transmit.

20 Claims, 6 Drawing Sheets

HIGH RESOLUTION ELECTRON GUN

This invention has been conceived and reduced to practice under contract with the U.S. Government Contract No. N00024-87-C-5250, which has a license to practice the invention.

BACKGROUND OF THE INVENTION

1. Field of the Invention

The present invention relates to electron guns for use in cathode ray tubes and, more particularly, to an improved electron gun configuration enabling enhanced image resolution on the screen of a cathode ray tube.

2. Description of the Related Art

Cathode ray tubes (CRTs) have been used since the early 1900's to project images onto screens and are commonly used today in computer terminals and television sets. A CRT utilizes a vacuum tube in which cathode rays, usually in the form of narrow beams, are projected onto a fluorescent screen to produce a luminous spot on the screen. Cathode rays are produced by an electron gun which propels a stream of electrons toward the screen via a strong electric field created inside the vacuum tube.

The typical electron gun includes a cathode, a control grid and an anode. A thermionic heater raises the temperature of the emitting surface of the cathode to a point at which thermionic electron emission can occur. By applying a large voltage differential between the cathode and the anode, the electrons can be drawn from the cathode emitting surface into the projected beam. Application of a negative voltage to the control grid between the cathode and the anode causes the beam to shut off. By modulating the voltage on the control grid, the beam intensity can be varied.

It has long been desired within the art to improve the resolution of an image visible on the CRT screen. The image is formed by numerous spots projected onto the screen. If each individual spot size could be decreased, a greater number of spots per unit area of screen can make up a particular image, thus increasing its sharpness or resolution. Accordingly, most efforts to improve CRT screen resolution center on reducing the spot size.

A problem which consistently hinders spot size reduction is beam spreading. When the electron gun emits the beam, the path of the electrons tends to diverge. This divergence, or beam spreading, causes a wider spot than desired to be projected onto the screen.

Various techniques are employed to reduce the beam spreading phenomenon. One such technique involves the use of apertures to filter or clip the outer diameter of the beam. The aperture would comprise a small hole placed in a charged plate positioned between the electron gun and the screen. As the beam passes through the aperture, the diverging electrons strike the edges of the aperture, and are shunted off. Apertures are effective in reducing the diameter of the beam, resulting in a smaller spot size being projected onto the screen.

Although aperture usage has a beneficial effect on resolution, it has an associated drawback with regard to brightness. By shunting off electrons from the beam, the overall intensity of the beam is reduced since fewer electrons remain in the beam which ultimately reaches the screen to form the spot. As a result, the brightness of the spot is reduced. To remedy the degraded brightness, the voltage on the control grid can be increased, or driven more positive relative to the cathode. However, the conventional wisdom in the art of electron guns is that an increase in the drive voltage would further degrade the resolution on the screen, since greater beam spreading would result. Thus, CRT electron gun designers were required to strike a balance between resolution and brightness, in that both parameters could not be maximized simultaneously.

SUMMARY OF THE INVENTION

Accordingly, it is an object of this invention to improve the screen resolution associated with an electron gun while maintaining an adequate brightness level.

In accomplishing this and other objects, there is provided an improved electron gun having a cathode, a control grid and an anode. A positive voltage is applied to the anode for the purpose of drawing the electron beam from the cathode, which emits the electron beam along its principal axis. The control grid between the cathode and the anode has a modulating drive voltage to modulate the emitted beam. The anode and the grid are aligned along the principal axis of the cathode and are adjacent to one another. A limiting aperture is mounted along the principal axis to clip the beam and reduce its diameter. A screen is provided along the principal axis to receive the projected beam.

To obtain the increased resolution, the modulating drive voltage is increased while the aperture size is decreased. More specifically, the modulating drive voltage is increased beyond 25% of a predetermined maximum cutoff value, and the limiting aperture permits less than 50% of beam current to transmit. In specific illustrative examples, apertures of 0.070 inches 0.036 inches, and 0.020 inches have been successfully employed using voltages on the order of 0 to −45 volts relative a cutoff value of −60 volts to yield beam widths on the order of 1.0 to 1.5 mils having good screen brightness, for an electrostatically focused electron gun. Beam widths produced by magnetically focused guns show even greater reduction in beam width, yielding widths of 0.65 to 0.90 mils while using similar apertures and voltage levels.

A more complete understanding of the improved resolution electron gun will be afforded to those skilled in the art, as well as a realization of additional advantages and objects thereof by a consideration of the following detailed description of the preferred embodiment. Reference will be made to the appended sheets of drawings which will be first described briefly.

DESCRIPTION OF THE PREFERRED EMBODIMENT

Figure 1:
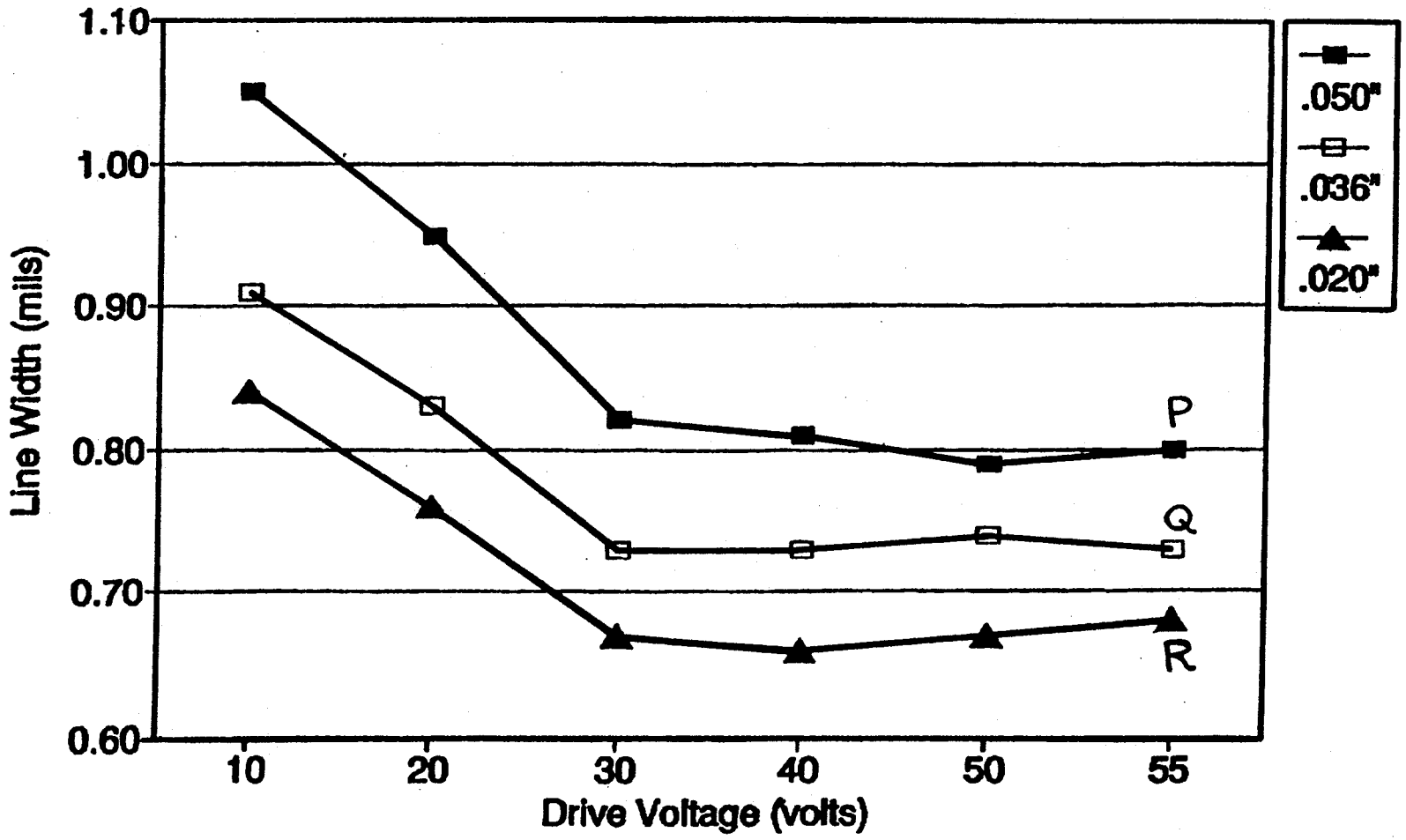
FIG. 1 is a graph depicting a relationship between drive voltage, aperture size, and a resulting line width which can be resolved on a screen for an electron gun that is electrostatically focused.

Referring first to FIG. 1, there are illustrated five curves relating static drive voltage differential, aperture size, and width of a line which can be resolved on a screen for particular electron gun configurations. Static drive voltage differential refers to the difference between a voltage applied to a control grid placed between a cathode and an anode of an electron gun, and a maximum cutoff voltage. Aperture size refers to the diameter of an opening through which energy transmissions, or beams, from the cathode pass. Line width refers to a measure of the diameter of the beam emitted from the cathode. As substantially described above, a reduction in line width corresponds with decreased spot size, and ultimately improved screen resolution. The focusing method for the electron gun used in FIG. 1 is electrostatic.

Note that for an unapertured beam from an electron gun, resolution degrades as the static drive voltage differential is increased since the line width increases as the static drive voltage differential increases (Curve A). Introduction of a limiting aperture to the system to clip the beam continues to increase the line width, although at a reduced rate from the unapertured gun (Curves B and C). These curves represent the conventional wisdom in the art, that increases in drive voltage degrades resolution, but the degradation can be minimized with the use of apertures.

However, when the aperture size is reduced to 0.036 inches, this degrading resolution phenomenon reverses and resolution actually improves as the static drive voltage differential is increased (Curve D). This phenomenon is also apparent for a 0.020 inch aperture (Curve E). The downward slope of the curve shows line width continuing to decrease as the drive voltage differential increases. Thus, an electron gun having an aperture which is less than 0.036 inches matched with a control grid which operates at a drive voltage differential between 10 and 30 volts would be expected to improve the screen resolution for the electron gun. An electron gun using an aperture smaller than 0.035 inches has substantially reduced beam current, and is known as a "heavily apertured" gun.

Figure 2:
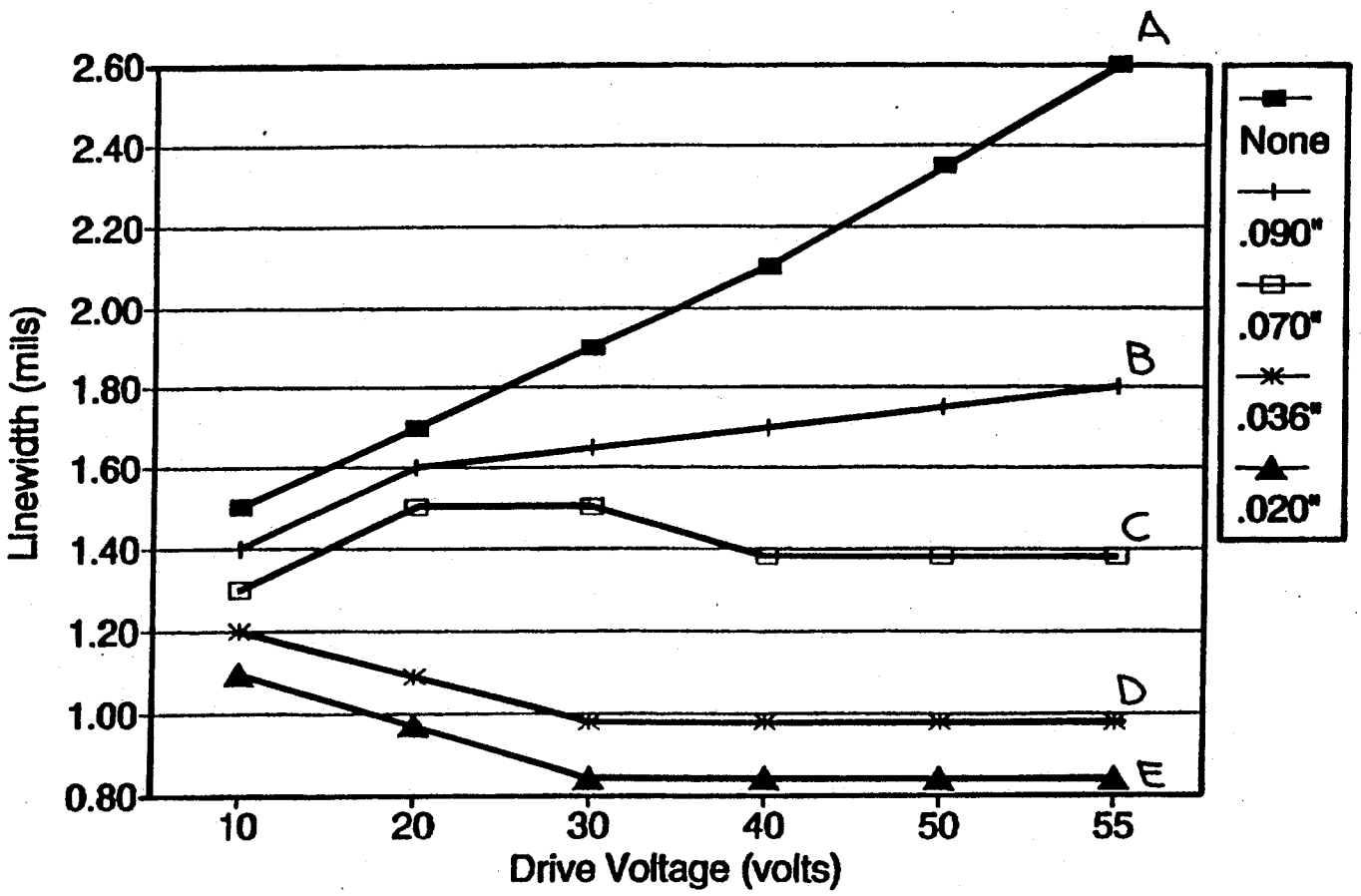
FIG. 2 is a graph depicting a relationship between drive voltage, aperture size, and a resulting line width for a magnetically focused electron gun.

Referring now to FIG. 2, there is shown a set of three curves which display the relationship between static drive voltage differential, aperture size and line width generated by a magnetically focused gun. In a magnetically focused electron gun, a magnetic deflection coil causes the beam to scan across the screen and a focusing coil optimizes the beam produced by the electron gun. A magnetically focused gun normally produces a narrower line width over that of an electrostatically focused gun. As with the electrostatically focused gun, the curves depicting the 0.050 inch aperture (Curve P), the 0.036 inch aperture (Curve Q) and the 0.020 inch aperture (Curve R) exhibit a dramatic decrease in line width as the applied static drive voltage differential is increased from 10 to 30 volts.

These curves demonstrate that the conventional wisdom is wrong, and that an increase in voltage applied to an electron gun does not necessarily cause a degradation in screen resolution. Resolution can be improved under conditions in which the voltage differential is increased and the resulting beam passed through a small enough aperture such that the spot size projected decreases. Further, the curves illustrate that the focusing method selected does not change the line width narrowing effect observed. It is theorized that the improved line width is due to the fact that only the centermost paraxial electrons emitted from the cathode can now pass through the limiting aperture and reach the screen at the higher drive voltage.

Figure 3:
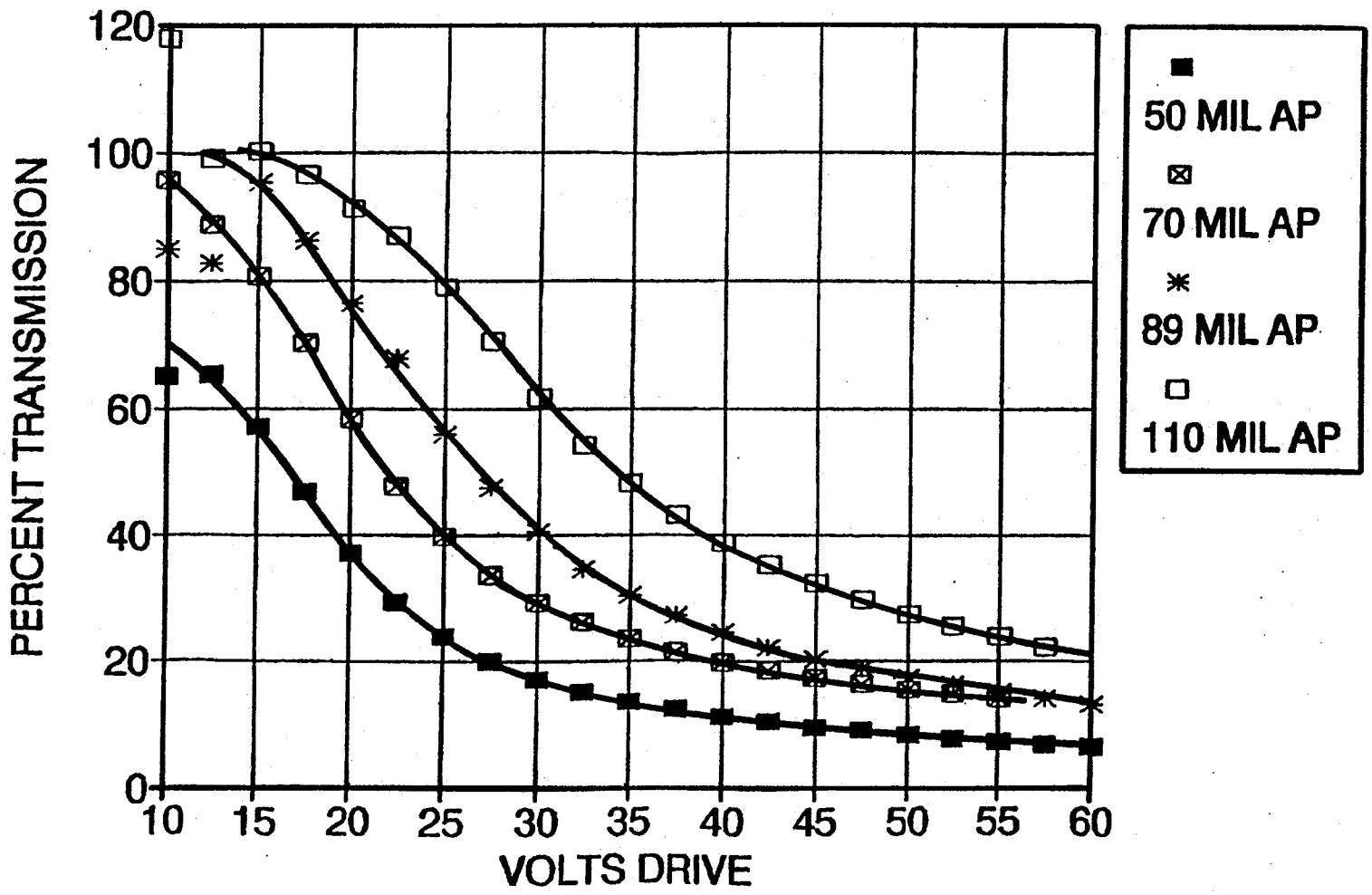
FIG. 3 is a graph depicting a relationship between beam transmission and drive voltage for an electrostatically focused electron gun.
Figure 4:
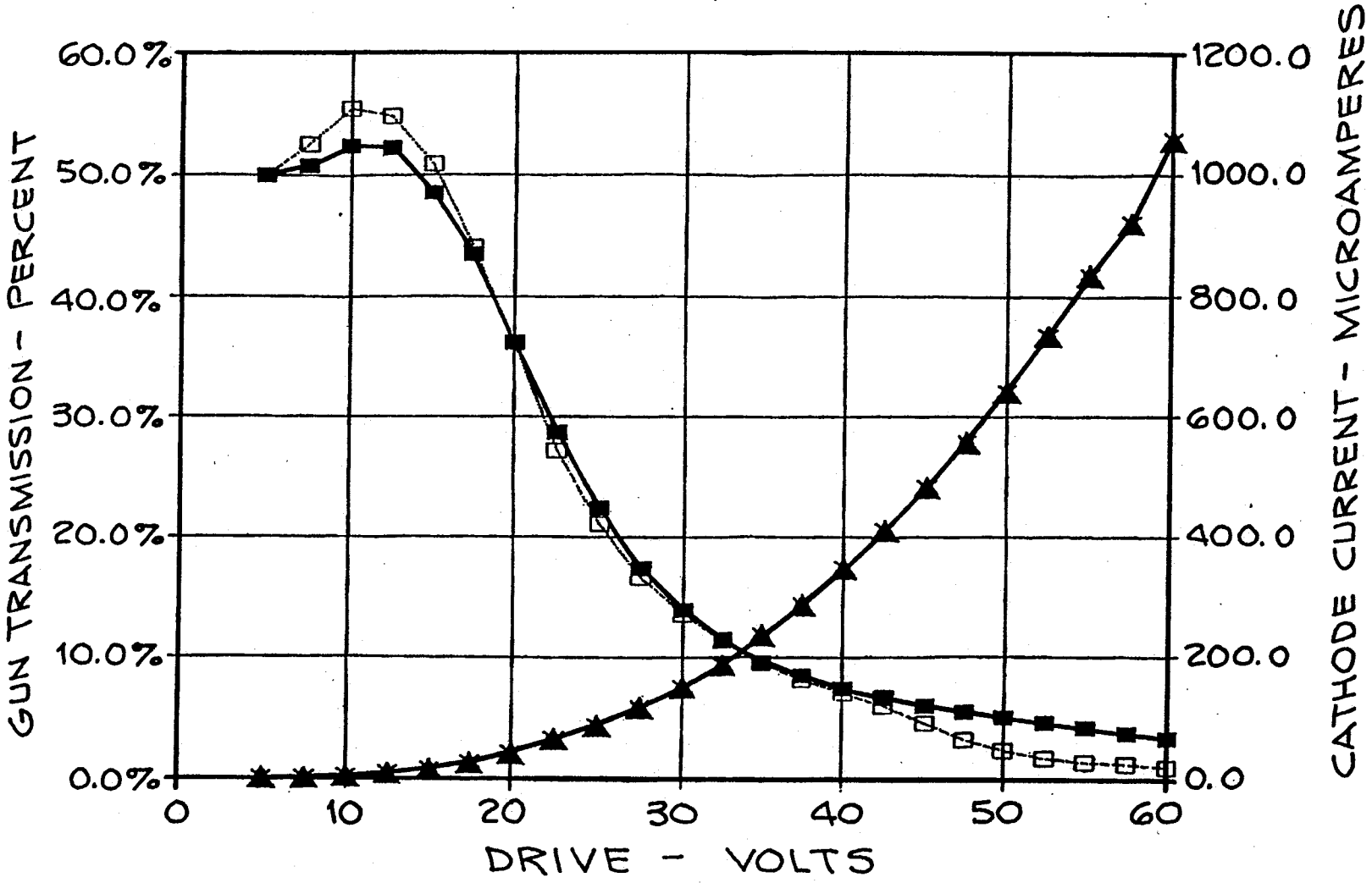
FIG. 4 is a graph depicting a relationship between beam transmission and drive voltage for a magnetically focused electron gun.

FIG. 3 shows a relationship between transmission rate for a variety of apertures and an associated drive voltage for an electrostatically focused electron gun. Transmission rate refers to the percentage of current remaining in the beam after passing through the aperture. A magnetically focused gun shows a similar drop in beam current transmission with increasing drive voltage for the 0.050 inch aperture case, as shown in FIG. 4. For each gun, as the size of the aperture is decreased, the percentage of beam current also decreases. The percentage of beam current transmission drops as the drive voltage is increased, until a point in which the drop in transmission rate appears to level off.

Even though the aperture transmission rate is reduced, the increase in drive voltage results in a greater amount of beam current actually reaching the screen. Most likely there are a greater percentage of paraxial electrons are remaining in the beam at the higher drive voltage level, which accounts for the decrease in line width. Thus, the improvement in line width demonstrated in FIGS. 1 and 2 is associated with apertures having transmission rates below 50%, but that greater improvement can be seen with apertures having rates as low as 5% (for the magnetically focused case).

Figure 5:
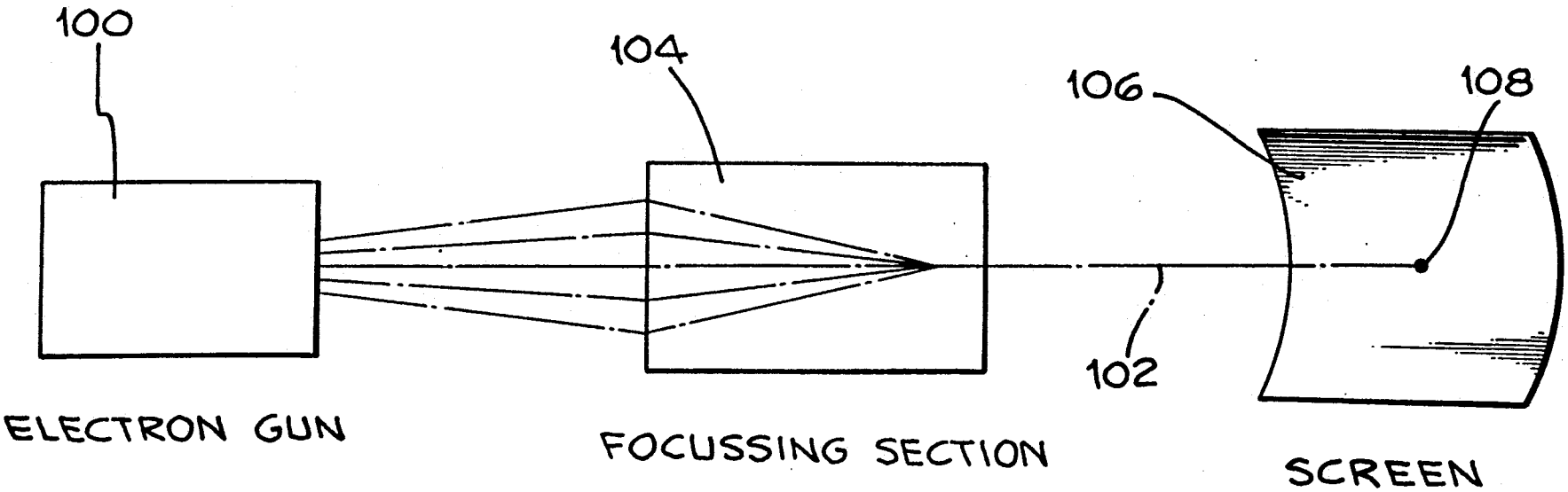
FIG. 5 is a block diagram of a system for projecting an electron beam onto a screen of a cathode ray tube.

In general, an apparatus which incorporates the teachings of the above described curves is illustrated in FIG. 5. An electron gun 100 emits an electron beam 102, which is focused and narrowed by a focusing section 104. The electron beam 102 then contacts a screen 106 which results in a spot 108 on the screen.

Figure 6:
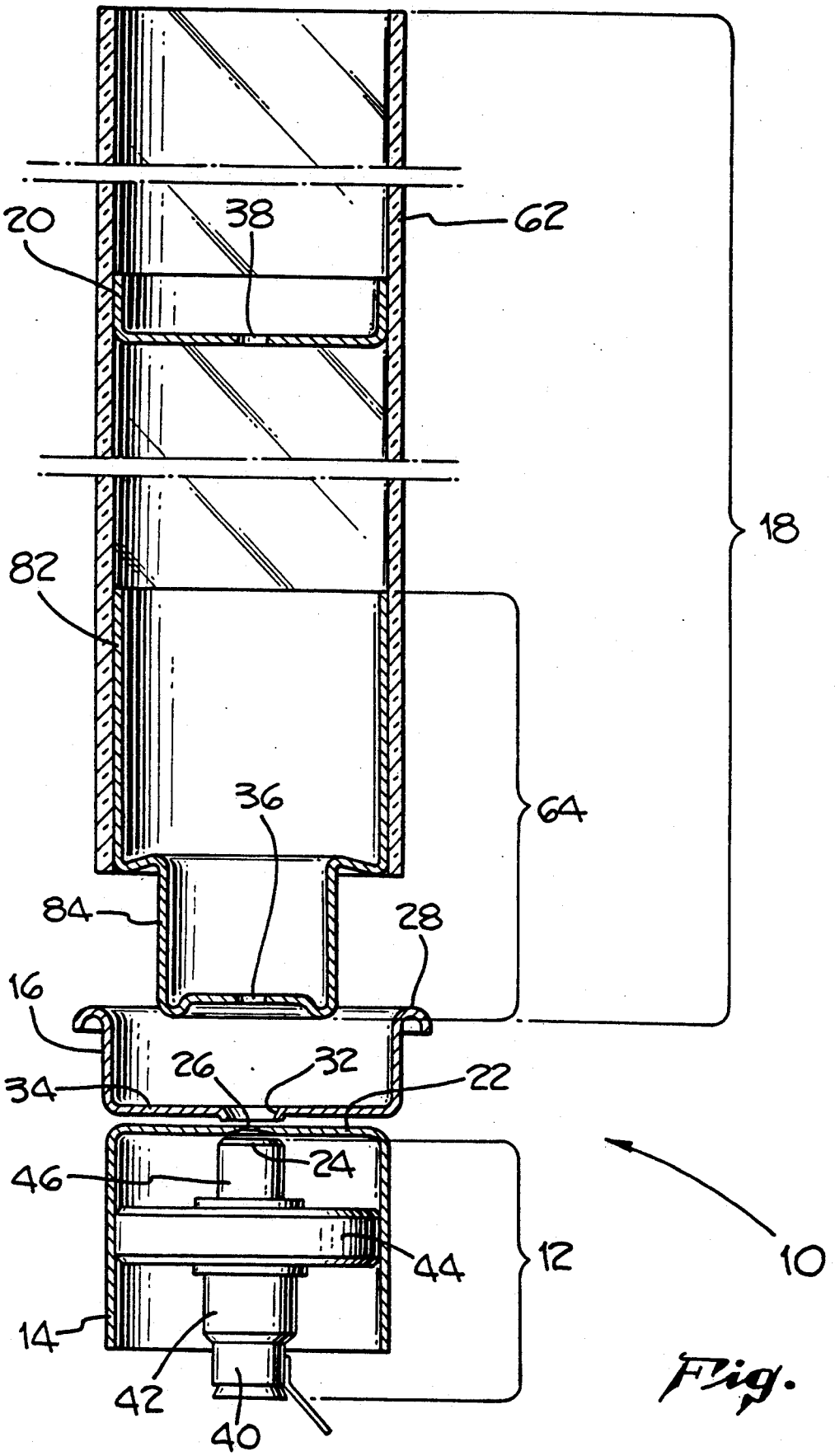
FIG. 6 is a cross-sectional side view of an electron gun of the present invention.

A preferred embodiment of the apparatus is shown in FIG. 6, which depicts a high resolution cathode ray tube assembly 10. A cathode 12 is aligned with a control grid 14, a first anode 16 and a second anode 18. Finally, a clipping aperture 20 is used to restrict the beam current emanating from the second anode 18.

The cathode 12 is an oxide coated metal which operates at ground potential, or 0 volts. The cathode 12 is heated to a temperature at which electrons are thermionically emitted from the cathode surface into the surrounding vacuum. The cathode 12 consists of four cylindrical sections, a lower cylindrical section 40 to which thermionic heat is applied, a middle cylindrical section 42, a large cylinder section 44 which fits within the control grid 14, and an upper cylindrical section 46 which is oxide coated at its upper end. All four cylindrical sections are aligned along their center axis The cathode 12 is positioned inside of the control grid 14 such that the oxide coated emitting surface of the cathode is oriented toward an open aperture of the control grid, which will be further described below.

The control grid 14 modulates between 0 volts and a maximum negative cutoff voltage. Note that the abscissa depicted in the graphs of FIG. I and FIG. 2 represents the differential drive voltage, which is the difference between the voltage applied to the control grid 14 and the cutoff voltage. This differential drive voltage comprises a positive value with respect to the cutoff voltage. The control grid 14 is driven negative to cut off the electron beam 102 from the cathode 12, and then is allowed to become less negative to allow the electron beam 102 emitted from the cathode to flow toward the first anode 16. By modulating the control grid 14, the supply of electrons drawn off the cathode 12 may be increased or decreased as necessary to vary spot intensity or brightness. In the preferred embodiment, the control grid 14 would operate with a cutoff voltage of −60 volts.

The control grid 14 is mounted axially with the cathode 12 and along the longitudinal axis of the cathode. The control grid 14 has a hollow cylindrical cup shape with a rounded edged top 22. The control grid 14 is mounted over the cathode such that the emitting end 24 of the cathode 12 is contained within the control grid and the top 22 is facing away from the cathode. At the center of the top 22 of the control grid 14 is an aperture 26 through which electrons from the cathode 12 are emitted. Since the control grid 14 is dynamically operated at a negative potential with respect to the cathode 12, none of the electrons are shunted off by the control grid, but instead pass through to the first anode 16.

The first anode 16 is mounted axially with the cathode 12 and the control grid 14 and along the longitudinal axis of both the cathode and the control grid. The first anode 16 is also cup shaped, and resembles the shape of the control grid 14. An aperture 32 is provided in a facing surface 34 of the first anode 16 which faces the control grid 14 and allows the beam to pass through. The purpose of the first anode 16 is to draw the current off the cathode 12 while the control grid 14 is modulated to either increase or decrease the flow of electrons. The first anode 16 is operated at a constant value of approximately 1,000 volts.

The second anode 18 accelerates the electron beam 102 after it passes through the first anode 16. The second anode 18 consists of a flanged tube 62, a lower grid member 64 and a clipping aperture grid 20 mounted within the flanged tube, the tube being oriented axially with the control grid 14, the first anode 16 and the cathode 12. The second anode 18 is operated at approximately the voltage of the screen 106, or 20,000 volts. The lower grid member 64 consists of two cylindrical members, an upper member 82 mounted inside the second anode tube and a lower member 84 oriented to extend into the first anode 16. This lower grid 64, and specifically its lower member 84, contains an aperture 36 which is aligned with the aperture 26 of the control grid 14 and the aperture 32 of the first anode 16.

The clipping grid 20 is a cup shaped element with rounded base edges, and which is oriented in the same fashion as the first anode 16. The clipping grid 20 has a center clipping aperture 38 through which the beam passes. Only the innermost portion of the electrons within the beam 102 pass through the clipping aperture 38. As described above, the measure of the effectiveness of the clipping aperture 38 is determined by the ratio of the amount of current that passes through the aperture over the amount of current that enters the second anode 18, or its transmission rate.

The screen 106 is oriented approximately perpendicular to the axis of the beam beyond the end of the second anode flanged tube 62. Since the screen 106 operates at approximately 20,000 volts, it comprises a final anode to draw the electron beam 102 from the cathode 12. In a magnetically focused gun, the second anode 18 and the screen 106 are generally electrically connected together. A focusing coil (not shown) located beyond the second anode 18 controls the direction of the beam toward the screen 106. In an electrostatically focused gun, there is a voltage potential between the second anode 18 and the screen 106, and an additional focusing grid (not shown) is provided to control beam direction.

To operate the electron gun 10, heat is applied to the cathode 12 until electrons are emitted. The electron beam 102 is drawn off the cathode 12 by the first anode, with the control grid 14 modulating the beam. The second anode 18 accelerates the electron beam 102, and the beam is clipped by the clipping aperture 20. The drive voltage applied to the control grid 14 and the amount of beam current emitted through the clipping aperture 20 determine the resolution of the spot 108 observed on screen 106, as demonstrated in the curves of FIGS. 1 and 2. For a gun having a maximum cutoff voltage drive voltage of −60 volts, the reduction in line width would be seen most dramatically as the voltage increases beyond 25% of the maximum, when used with a clipping aperture which reduces beam current by greater than 50%. The line width would continue to improve until the voltage has increased to 50% of the maximum, and the clipping aperture reduces beam current by 95%. After this point, the improvement would tend to level off while remaining at the improved level.

Having thus described a preferred embodiment of an improved resolution electron gun, it should now be apparent to those skilled in the art that the aforestated objects and advantages for the within system have been achieved. It should also be appreciated by those skilled in the art that various modifications, adaptations, and alternative embodiments thereof may be made within the scope and spirit of the present invention. For example, an electron gun having electrostatic focussinq would be expected to exhibit the same resolution characteristics. Different cathode configurations and voltages could be selected, so long as the basic concept of improving resolution by increasing the drive voltage with a heavily apertured beam is utilized.

The present invention is further defined by the following claims.

What is claimed is:

1. An electron gun of a cathode ray tube to project an electron beam onto a screen of said cathode ray tube, said electron gun comprising:

a cathode having an electron emitting surface, a first anode having a high positive voltage, and a control grid between said cathode and said first anode and aligned along an axis formed by said cathode and said first anode, intensity of said electron beam varying in response to a drive voltage applied to said control grid, said drive voltage being greater than 30% of a maximum cutoff voltage;

a second anode located beyond said first anode and aligned along said axis, said second anode having a relatively high positive voltage to accelerate said electron beam, said voltage at said second anode being substantially higher than said voltage at said first anode; and a clipping aperture located within said anode aligned along said axis and receiving a centermost portion of said accelerated electron beam therethrough with an outer portion of said beam being shunted off, said clipping aperture allowing transmission of less than 50% of said beam and being less than 0.070 inches in diameter;

wherein, said screen receives said centermost portion of said electron beam, and an increase in said drive voltage results in a corresponding decrease in line width of said beam measured at said screen.

2. The electron gun as defined in claim 1, wherein said electron beam is magnetically focused.

3. The electron gun as defined in claim 1, wherein said electron beam is electrostatically focused.

4. The electron gun as defined in claim 1, wherein the clipping aperture allows transmission of less than 25% of said electron beam.

5. The electron gun as defined in claim 1, wherein said drive voltage is greater than 35% of said maximum cutoff voltage.

6. The electron gun as defined in claim 5, wherein the clipping aperture allows transmission of less than 5% of said electron beam.

7. The electron gun as defined in claim 6, wherein drive voltage is greater than 40% of said maximum cutoff voltage.

8. The electron gun as defined in claim 7, wherein said drive voltage is greater than 45% of said maximum cutoff voltage.

9. An electron gun of a cathode ray tube to project an electron beam onto a screen of said cathode ray tube, said electron gun comprising:

a cathode having an electron emitting surface, a first anode having a high positive voltage to draw said beam from said surface, and a means for controlling intensity of said electron beam in response to a drive voltage applied to said controlling means, said drive voltage being greater than 25% of a maximum cutoff voltage;

a second anode located beyond said first anode and having a relatively high positive voltage to accelerate said electron beam, said voltage at said second anode being substantially higher than said voltage at said first anode; and a clipping means for receiving a centermost portion of said accelerated electron beam therethrough with an outer portion of said beam being shunted off, said clipping aperture allowing transmission of less than 50% of said beam;

whereby, an increase of said drive voltage results in a corresponding decrease of line width of said beam measured at said screen.

10. The electron gun as defined in claim 9, wherein said controlling means further comprises a control grid disposed between said cathode and said first anode and aligned along an axis formed by said cathode and said first anode.

11. The electron gun as defined in claim 10, wherein said clipping means comprises a clipping aperture located within said second anode aligned along said axis and is less than 0.070 inches in diameter.

12. The electron gun as defined in claim 11, wherein said screen receives said centermost portion of said electron beam.

13. The electron gun as defined in claim 12, wherein said drive voltage comprises at least 40% of a maximum cutoff voltage.

14. The electron gun as defined in claim 9, wherein said maximum cutoff voltage is −60 volts and said drive voltage has a static value of −27 volts.

15. A method for improving resolution of an electron beam projected by an electron gun onto a screen of a cathode ray tube, said electron gun comprising a cathode having an electron emitting surface, a first anode having a high positive voltage, and a control grid between said cathode and said first anode and aligned along an axis formed by said cathode and said first anode, intensity of said electron beam varying in response to a drive voltage applied to said control grid, the method comprising the steps of:

passing a centermost portion of said electron beam through a clipping aperture which shunts off an outer portion of said beam, said clipping aperture allowing transmission of less than 50% of said beam, said clipping aperture being disposed within a second anode of said electron gun, said second anode having a voltage which is substantially higher than said voltage at said first anode; and increasing said drive voltage to a value greater than 25% of a maximum cutoff value.

16. The method for improving resolution of an electron beam as defined in claim 15, wherein a size of said clipping aperture is selected to produce a negative sloping curve on a drive voltage-line width graph.

17. The method for improving resolution of an electron beam as defined in claim 16, wherein said clipping aperture has a diameter of smaller than 0.070 inch.

18. The method for improving resolution of an electron beam as defined in claim 15, wherein said drive voltage is increased to −27 volts and said maximum cutoff voltage is −60 volts.

19. The method for improving resolution of an electron beam as defined in claim 18, wherein said electron beam is magnetically focused 20. The method for improving resolution of an electron beam as defined in claim 18, wherein said electron beam is electrostatically focused.

* * * * *